United States Patent [19]

Saraisky

[11] Patent Number: 4,582,273

[45] Date of Patent: Apr. 15, 1986

[54] INSERTS AND COOPERATING RETAINING MEANS FOR USE WITH WEB DISPENSING MEANS

[76] Inventor: Alfred Saraisky, 27 Cayuga Ave., Oakland, N.J. 07436

[21] Appl. No.: 572,990

[22] Filed: Jan. 23, 1984

[51] Int. Cl.[4] ..... B65H 75/02

[52] U.S. Cl. ..... 242/96; 242/55

[58] Field of Search ..... 242/55, 68.4, 68.6, 242/96, 99

[56] References Cited

U.S. PATENT DOCUMENTS

| | | | |
|---|---|---|---|
| 1,487,633 | 3/1924 | Washburn | 242/68.6 |
| 1,594,907 | 8/1926 | Grundler | 242/68.4 |
| 3,006,574 | 10/1961 | Hardy | 242/99 X |
| 3,743,203 | 7/1973 | Rancourt | 242/68.4 |
| 4,226,380 | 10/1980 | Gay | 242/55 |
| 4,248,392 | 2/1981 | Parry | 242/96 |

*Primary Examiner*—Stuart S. Levy
*Assistant Examiner*—Lloyd D. Doigan
*Attorney, Agent, or Firm*—Louis Weinstein

[57] ABSTRACT

Inserts for facilitating dispensing of wrapping material comprising an elongated web wrapped about a hollow cylindrical core. The inserts are telescopingly received within opposite ends of the hollow cylindrical core and are retained, in one preferred embodiment, by an elastic retaining member whose opposing ends are each releasably joined to the inserts. In another alternative embodiment, each insert is provided with a force-fit cylinder freely slidable relative to the insert and adapted to form a force-fit with the hollow cylindrical core, enabling the web supply to be rotated relative to the inserts, while an operator holds the inserts during a dispensing and wrapping operation.

9 Claims, 14 Drawing Figures

INSERTS AND COOPERATING RETAINING MEANS FOR USE WITH WEB DISPENSING MEANS

FIELD OF THE INVENTION

The present invention relates to apparatus for use in dispensing elongated webs and the like and more particularly to a novel insert system for use with such web supply rolls to facilitate dispensing of the web, to protect both the web and the operator, and to retain the inserts within the web roll core to prevent loss or damage thereto.

BRIEF DESCRIPTION OF THE INVENTION

The present invention is characterized by comprising an insert system which avoids all of the disadvantges of the prior art supply roll holding systems which protects the web from being cut, split or contaminated, and which is retained in the ends of the web core without friction between the core and the inserts, and regardless of the manner in which the roll is set down, said insert system being comprised of a suitable plastic material which is formed into a pair of generally hat-shaped inserts with hollow interiors, and being open at both ends, and a retention means which elastically retains the inserts within the web core. Each insert is an open-ended hollow cylinder with a brim-like flange on one end. The diameter of each cylinder is preferably substantially constant throughout its length, so that the walls of the inserted hat will be substantially parallel to the inside walls of the web roll core when the insert is telescopically received in the web roll core. The elastic retention means is removably secured to both inserts retaining them telescoped within the core to prevent the inserts from falling out of the core.

BACKGROUND OF THE INVENTION

In order to protect palletized merchandise from moisture and dirt in shipping and handling, such palletized merchandise is often wrapped with a web of clear plastic film. This web is dispensed from an assembly typically in the form of a web of indeterminate length wrapped around a hollow cylindrical core. The free end of the web is tucked into a starting point of the palletized merchandise. An operator then walks around the palletized merchandise holding the core and dispensing the web over the merchandise as he walks around the merchandise being wrapped.

Handling systems have been developed to facilitate the holding of the roll and dispensing of the web.

Because those handling systems have been expensive, cumbersome and fragile, many operators will dispense with them and hold the web roll in their bare hands. Since the web roll slides as it rotates relative to the operator's fingers as the web is dispensed, the operator risks cuts and burns from the web roll. In addition, the fingers of the operator may engage the edges of the web, which may cause the web to split or tear before the palletized merchandise is fully wrapped.

In order to avoid the shortcomings of conventional holding assemblies, as well as the undesirability of having an operator handle the web rolls with bare hands, holding members have been developed. These members generally consist of inserts which are placed into each open end of the web roll core. Each insert is shaped like a cylindrical hat with a wide flat brim. The operator puts his fingers into the interiors of the hats, which remain stationary as the web roll rotates. Thus, the operator's fingers are protected. The brim of the hat prevents contact between the fingers of the operator and the edges of the web. Such an insert system may be found in my previous U.S. Pat. No. 4,372,500.

Even this simple system has been found to have its drawbacks. Often an operator must lay down a web roll to attend to another matter. In order to avoid soiling the web with dirt or moisture which is often found on wsarehouse floors, the operator will stand the roll on one end. If extreme care is not taken while doing this, the protective insert may fall out of the web roll core. The insert might then be damaged if the roll is put down on top of it, or may equally as likely become lost. The operator using this system may thus find himself constantly replacing and refitting inserts in the web core. Besides being inconvenient, this arrangement is costly and time-consuming.

It is, therefore, one object of the present invention to provide a novel insert system for use with wrapping film supply rolls and the like for telescoping insertion into the ends of the supply rolls to facilitate the dispensing operation, for permitting substantially free rotation of the supply roll relative to the inserts as the web material is dispensed, while at the same time preventing the inserts from becoming dislodged from the web roll core.

Still another object of the present invention is to provide a novel insert system for use in dispensing wrapping material in the form of an elongated web from a supply roll, said inserts being light in weight and having a low coefficient of sliding friction, as well as a relatively loose engagement with the web roll core, to facilitate relative sliding movement between the inserts and the web roll core.

Still another object of the present invention is to provide a novel inserts system for use in dispensing wrapping material from a supply roll wherein retaining means are provided to keep the inserts engaged with the web roll core no matter how low the friction or loose the fit between the insert and the core.

The above as well as other objects of the present invention will become apparent when reading the accompanying description and drawing, in which.

Figure 3A:
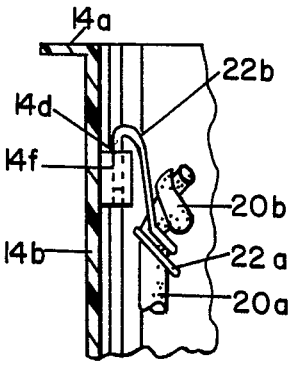
Figure 3B:
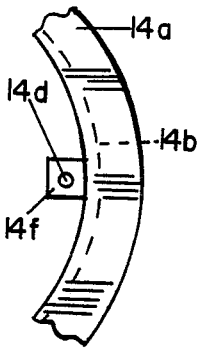

FIGS. 3*a* and 3*b* show sectional and partial end views of a modification of the present invention.

Figure 4A:
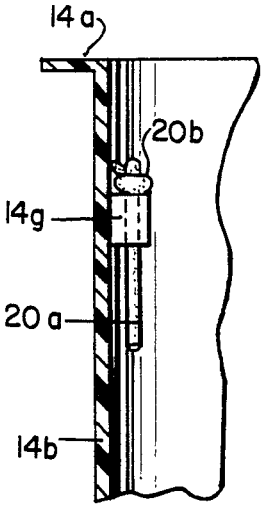
Figure 4B:
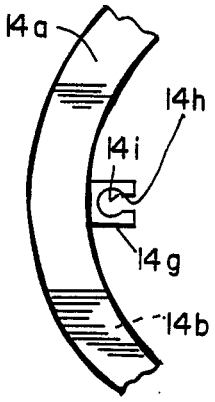

FIGS. 4*a* and 4*b* show sectional and partial views of another modification of the present invention.

Figure 5A:
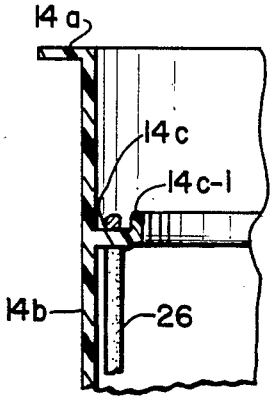
Figure 5B:
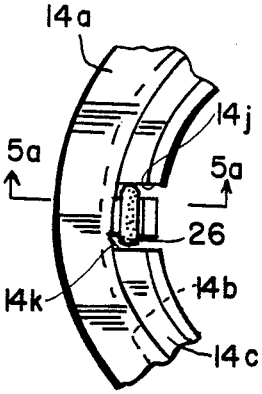

FIGS. 5*a* and 5*b* show sectional and end views of still another embodiment of the present invention.

Figure 6:
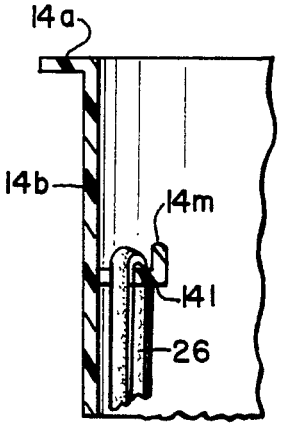

FIG. 6 is a sectional view of another embodiment of the present invention.

Figure 7A:
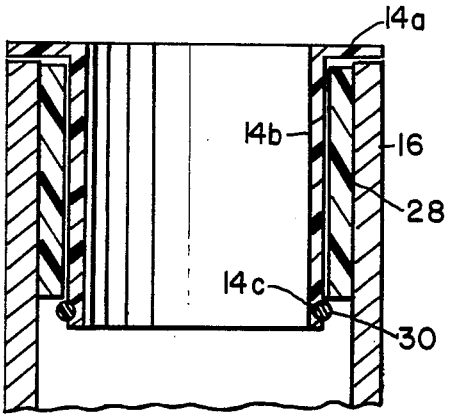
Figure 7B:
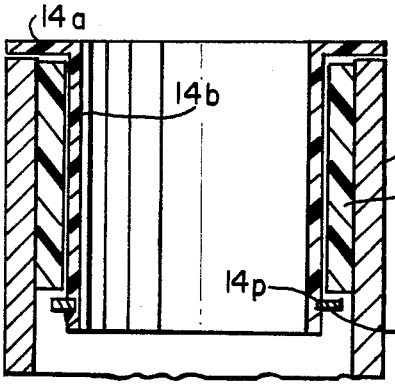
Figure 7C:
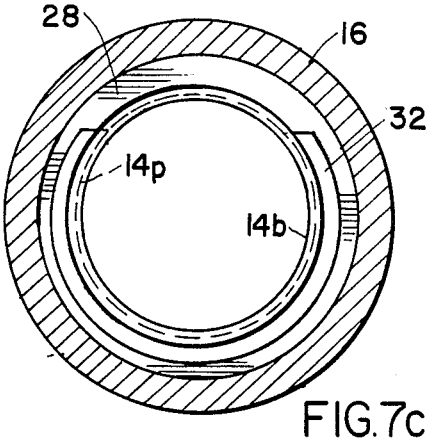
Figure 7:
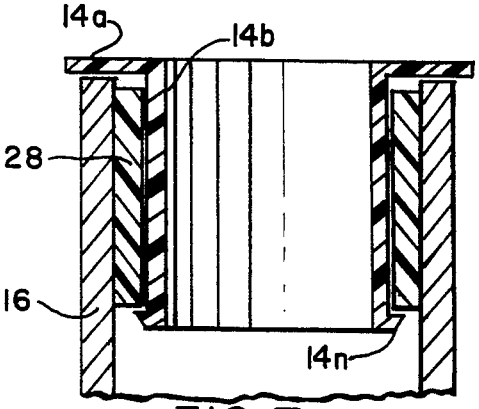

FIGS. 7, 7*a* and 7*b* are sectional views showing still another embodiment of the present invention.

DETAILED DESCRIPTION OF THE INVENTION

Figure 1:
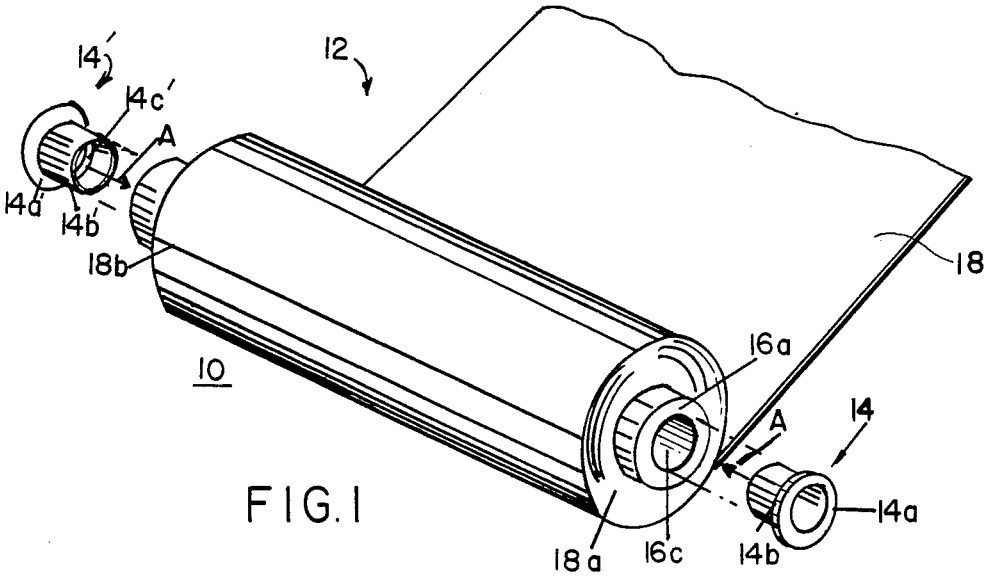
FIG. 1 is an exploded perspective view showing the manner in which the inserts are joined to a supply roll.

FIG. 1 shows an exploded view of the arrangement 10 of the present invention comprising a supply roll 12 and a pair of inserts 14, 14' arranged for telescoping insertion into the opposing open ends of supply roll 12 to facilitate a dispensing and wrapping operation as will be more fully described.

Supply roll 12 is comprised of a hollow cylindrical core 16 preferably formed of a rigid yet relatively lightweight material such as cardboard or stiff paper board. Elongated web 18 of indeterminate length is wrapped about cylinder 16. The web 18 may, for example, be a thin gauge transparent plastic film suitable for use in wrapping items which may be stacked upon a pallet. Film 18 is preferably a conventional film which is in widespread use and includes, for example, low density polyethylene film or PVC film. In the embodiment 10 of FIG. 1, the ends 16*a* and 16*b* of hollow cylindrical core 16 are shown as extending beyond the respective ends 18*a* and 18*b* of the web wrapped about core 16. However, the ends 16*a* and 16*b* may be flush with the wrapped ends of the web or possibly even recessed somewhat.

The interior 16*c* of cylindrical core 16 is preferably hollow throughout the entire length of the cylinder. Inserts 14 and 14′ are inserted into the opposite ends of cylindrical core 16 by pressing the inserts 14, 14′ into the interior in the directions shown by arrows 22, 22. Cylindrical sidewalls of the inserts 14, 14′ are telescopingly received within the cylindrical core 16.

Since the inserts 14 and 14′ are identical to one another, only one insert 14 will be described herein in detail for purposes of simplicity. Noting especially FIGS. 2 and 2*a*, insert 14 can be seen to comprise a substantially cylindrical shaped sidewall 14*b* which is preferably of constant diameter over its axial length. The outer diameter of cylindrical sidewall 14*b* is preferably slightly less than the inner diameter of cylindrical core 16*b* to permit easy insertion of sidewall 14*b* into cylindrical core 16*b* and, together with the nature of the material from which insert 14 is formed, provides a very low friction sliding fit between the engaging surfaces of cylindrical core 16 and insert 14.

The cylindrical sidewall 14*b* is open at both ends and is preferably provided with a flange 14*c* extending radially inward. Flange 14*c* is provided with a small opening 14*d* receiving the hooked end 20*a* of a resilient retaining assembly 20.

The opposite end of insert 14 is provided with an outwardly directed integral flange 14*a*.

Insert 14 may be formed through a vacuum forming technique, injection molding, stamping, or any other manufacturing process. The insert is preferably formed of a plastic material such as, for example, styrene or rubber-modified styrene, which materials have the characteristics of providing an insert which is relatively light in weight and quite durable and has a low coefficient of sliding friction. The thickness range of the insert is preferably in the range from 0.0625 to 0.250 inches, although a thinner or thicker insert may be provided if desired. The insert has a preferable thickness in the range from 0.115 to 0.135 inches. In addition, other plastic materials may be employed such as, for example, polyethylene or urythane or any plastic material exhibiting characteristics similar to those set forth hereinabove.

As was described hereinabove, the cylindrical portion 14*b*, 14*b*′ of each insert 14 is aligned with the hollow open ends 16*a*, 16*b* of cylindrical core 16 and is slid inwardly so as to be telescopingly received thereby. Although the cylindrical sidewalls 14*b*, 14*b*′ are freely slidable within cylindrical core 16, both members are retained therein by retaining assembly 20 comprised of an elongated elastic stretchable member 20*a* having a suitable diameter so as to be capable of stretching without breaking. Elongated member 20*a* is preferably formed of rubber or a rubber-like material or any plastic material exhibiting the requisite characteristics mentioned hereinabove.

Figure 2:
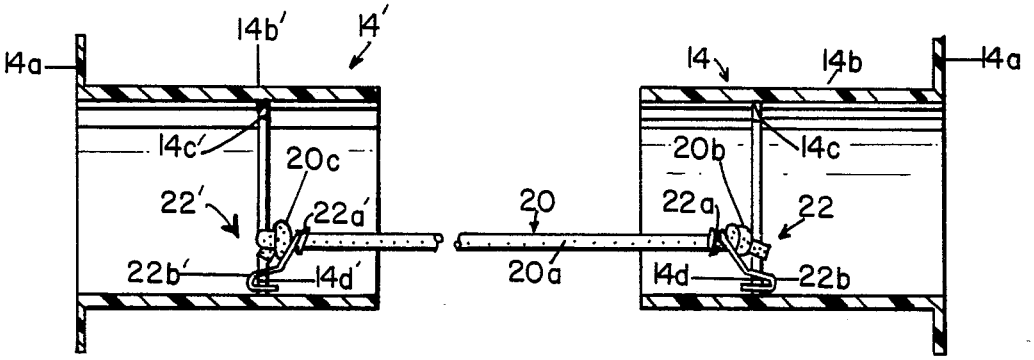
FIG. 2 is a sectional view showing the cooperating relationship between the inserts and the resilient elastic retention means.
Figure 2A:
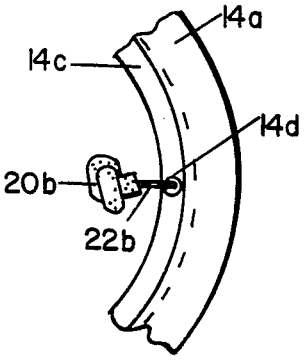

In the embodiment shown in FIGS. 2 and 2*a*, a pair of hooking members 22, 22′ are provided for coupling with each of the inserts 14, 14′. Members 22, 22′ are preferably formed of a suitable metallic wire provided with a twisted end forming several turns 22*a*, 22*a*′ wound about elastic member 20. The opposite end of wire 22, 22′ is bent to form a hooked end 22*b*, 22*b*′ which is arranged to extend into opening 14*d*, 14*d*′ in flange 14*c*, 14*c*′. An overhand knot 20*b*, 20*c* is formed near each end of elastic member 20 to prevent removal of the hooked-shaped members 22, 22′ from elastic member 20.

Hook-shaped coupling member 22′ is substantially identical to hook-shaped member 22 and a second overhand knot 20*c* is provided at the opposite end of elastic member 20 to prevent removal of hook-shaped member 22′ from elastic member 20. The hook end 22*b*′ is received within an opening 14*d*′ in the flange 14*c*′ of insert 14′.

The manner in which the retainer assembly 20 is mounted is by insertion of a first of the inserts, for example, insert 14, into one end of cylindrical core 16. One hook end 22*b* is inserted into opening 14*d*. Insert 14′ is telescopingly received within the opposite end 16*b* of cylindrical core 16 and the free end of resilient member 20*a* is drawn through the cylindrical core, causing it to stretch, until the hook-shaped end 22*b*′ is arranged just beyond opening 14*d*′. With the hook-shaped end 22*b*′ in alignment with the opening, the elastic member 20*a* is released allowing the elastic member to retract from its stretched and expanded condition. However, the length of the elastic member is chosen relative to the separation distance between flanges 14*c* and 14*c*′ so as to be partially stretched and remain under some tension in order to urge inserts 14, 14′ toward one another, and thereby retain the inserts within core 16. The inserts 14, 14′ will be retained within cylindrical core 16 during handling or when placed to one side, thereby eliminating the need for exercising any degree of care in the manner in which the wrapped roll is set aside during non-use or picked up in readiness to begin a wrapping operation.

When the wrapping web 18 is exhausted, the inserts 14, 14′ may be removed from the cylindrical core 16 simply by gripping one of the hook-shaped members 22*b*, 22*b*′, pulling it in an outward direction from the adjacent end of the cylindrical core 16 until the hook-shaped member is clear of its associated opening 14*d* and thereafter simply releasing the hook-shaped member allowing it to fall free of the insert. Thereafter, both inserts 14, 14′ may be easily removed from the cylindrical core 16.

During use, the tension imposed upon the inserts 14, 14′ by elastic member 20*a* is sufficient to retain the inserts within the core 16, but is not so great as to interfere with the ability of both inserts to slide relative to the cylindrical core 16, thereby enabling an operator to grip each of the inserts 14, 14′ as the operator walks about a large stack of merchandise enabling the web 18 and core 16 to rotate freely while the operator's hands hold the inserts 14, 14′ stationary during the wrapping operation. If for any reason an operator wishes to set the assembly 10 aside to perform any other duty, the elastic member 20*a* is under sufficient tension to prevent the inserts 14, 14' from being released or dropping out of the cylindrical core 16.

FIGS. 3 through 7 show other embodiments of the present invention.

For example, considering FIGS. 3*a* and 3*b*, the inserts 14, 14' need not be provided with a continuous internal integral flange. As shown in FIGS. 3*a* and 3*b*, the continuous internal annular flange 14*c* is replaced with a single integral projection 14*f* extending radially inwardly from cylindrical sidewall 14*b* and provided with an opening 14*d* for receipt of the hook-shaped end 22*b* of coupling member 22. Although the flange 14*f* is shown as having a rectangular shape, the flange may alternatively have a rounded free end or any other suitable shape.

FIGS. 4*a* and 4*b* show another alternative embodiment of the present invention in which an integral projection 14*g* is provided along the interior of cylindrical sidewall 14*b*. The projection 14*g* projects radially inward and has a substantially keyhole-shaped elongated opening comprised of a narrow portion 14*h* communicating with a circular-shaped portion 14*i* having a diameter of significantly greater width than the narrow opening 14*h*. In the embodiment shown in FIGS. 4*a* and 4*b*, the metallic coupling hook 22 is eliminated, the elongated stretchable member 20*a* is passed through the narrow portion 14*h* of the opening so as to be received within the larger diameter portion 14*i* with the knotted portion 20*b* resting immediately above the top end of the enlarged opening portion 14*i*, as shown best in FIG. 4*a*. It should be understood that both inserts 14 and 14' will be provided with a projection 14*g*. in order to release the stretchable member 20*a*, the knot portion 20*b* is pulled upwardly as shown by the arrow A in FIG. 4*a*, whereupon the stretchable member 20*a* is then moved toward the right to remove the stretchable member 20*a* from both the large diameter opening 14*i* and the narrow opening 14*h*. The embodiment of FIGS. 4*a* and 4*b* is equally effective in retaining the inserts 14 and 14' within cylindrical core 16.

FIGS. 5*a* and 5*b* show still a further embodiment of the present invention in which the annular continuous integral flange 14*c* is notched or cut to form a pair of spaced slits 14*j*, 14*k*. Instead of using the elongated elastic member 20*a*, the embodiment of FIGS. 5*a* and 5*b* employs a closed loop stretchable member such as, for example, a rubber band 26 which is looped over the center portion of the flange 14*c* arranged between the slots 14*j* and 14*k*, as shown best in FIG. 5*b*. The rubber band 26 is arranged is a similar fashion to retain both of the inserts 14 and 14' in position within cylindrical core 16. The slightly upturned end 14*c*-1 of annular flange 14*c* serves to prevent the rubber band from being removed from the operative position, retaining both inserts 14 and 14' within the cylindrical core 16.

FIG. 6 shows still another alternative embodiment of the present invention in which the rubber band 26 may be looped around a single projection 141 integral with the interior surface of an extending generally inward from the cylindrical sidewall 14*b*. The rubber band 26 is looped around the projection 141, the free end of which extends upwardly as shown at 14*m* to retain the rubber band in the operative position.

As an obvious alternative, the elastic member 20*a* shown in the embodiment of FIGS. 2 and 2*a* may be replaced by a closed loop rubber band 26 which may be fitted with the metallic coupling member 22 adapted for insertion into the openings 14*d* and 14*d'* of the inserts 14 and 14' respectively.

FIG. 7 shows still a further embodiment of the present invention which eliminates the need for elastic stretchable members. The embodiment shown in FIG. 7 in sectional view is comprised of an insert 14 having an integral flange 14*n* at its lower end and provided with a cylindrical shaped force-fit cylinder 28 whose axial length is slightly less than the distance between flanges 14*e* and 14*n*, and whose inner diameter is slightly greater than the outer diameter of cylindrical sidewall 14*b*, so as to be freely slidable relative to insert 14, and whose outer diameter is greater than the outer diameter of flange 14*n* and less than the outer diameter of flange 14*e*, and also greater than the inner diameter of cylindrical core 16. The outer edge of flange 14*n* is tapered as shown in FIG. 7 to permit the force-fit cylinder 28 to be slidably mounted on to the insert 14. Once the bottom edge of the force-fit cylinder passes beyond the upper surface of flange 14*n*, this flat surface prevents the force-fit cylinder from being removed from insert 14. The manner of use of the embodiment shown in FIGS. 7 and 7*a* is as follows:

The insert assembly is arranged with the flange 14*n* positioned opposite one end of cylindrical core 16. The assembly is then pushed into core 16 so as to be telescopingly received therein with the outer periphery of force-fit cylinder 28, force-fittingly engaging the interior periphery of cylindrical core 16.

Insert 14 is pressed inwardly until the flange 14*e* substantially immediately overlies the end 16*c* of cylindrical core 16. The force-fitting engagement between force-fit cylinder 28 and cylindrical core 16 prevents the insert assembly from being accidentally removed from the cylindrical core. The arrangement is such, however, that the insert 14 is free to rotate relative to cylindrical core 16 and force-fit cylinder 28 permitting the inserts 14 and 14' to be operated in the manner similar to those described hereinabove when performing a wrapping operation. The insert assemblies cannot be accidentally removed, but may be removed intentionally once the wrapping web 18 is exhausted.

The inserts are removed simply by forcefully pulling the inserts out of the core with a force sufficient to overcome the force-fitting friction fit between inserts 14 and 14' and the cylindrical core 16.

Although the force-fit cylinder 28 is shown as having its entire outer peripheral surface engaging the interior surface of cylindrical core 16, portions of the outer peripheral surface may be raised or provided with projections, so as to reduce the amount of surface engagement between force-fit cylinder 28 and cylindrical core 16.

As another modification shown in FIG. 7*a*, the flange 14*n* of FIGS. 7 and 7*a* may be replaced with an elastic stretchable O-ring 30 seated within a groove 14*o* in the outer surface of sidewall 14*b*. The O-ring serves to prevent the friction-fit cylinder 28 from being displaced from insert 14. As is shown in FIGS. 7*b* and 7*c*, the O-ring 30 may be replaced by a C-clip 32 snap-fittingly received within a rectangular-shaped annular groove 14*b* in sidewall 14*b*.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A pair of inserts each arranged to be held by an associated one of the hands of an operator for use in dispensing a web from a supply roll, said web being an elongated sheet of wrapping film wrapped about a supply core comprising a hollow cylindrical core, said inserts each comprising:

a substantially hollow cylindrical section having first and second open ends, the diameter of said cylindrical section being substantially constant over the length of said section, at least the first end of said section being substantially perpendicular to the axis of rotation of said cylindrical section;

an annular-shaped flange having its inner periphery integrally joined to said first end and extending radially outwardly from said cylindrical section, the diameter of the outer periphery of said flange being greater than that of said cylindrical section said flange being substantially perpendicular to said cylindrical section;

at least one coupling means integrally joined to the interior of said cylindrical section;

said inserts being adapted for telescoping insertion into an associated end of said cylindrical core with said flange overlying at least the adjacent end of said cylindrical core, said inserts being formed of a plastic material having a low coefficient of sliding friction, the surface portion of said inserts slidably engaging said cylindrical core being smooth, whereby said insert is freely slideable and loosely engaged relative to said cylindrical core;

the length of said cylindrical core being greater than the combined lengths of said cylindrical sections whereby the adjacent ends of said cylindrical sections are spaced apart from one another;

elongated elastic retaining means having its opposite ends releasably secured to associated coupling means of said inserts, said retaining means being of a length which is less than the distance between the two coupling means when inserted in the hollow cylinder, said retaining means being stretched when secured to said coupling means to retain the pair of inserts within the hollow cylindrical core.

2. The apparatus of claim 1 wherein said elongated elastic retaining means further includes an elongated rubber or rubber-like member having first and second hook-shaped members secured at opposite ends of said elastic member;

each of said coupling means having an opening for receiving the end of an associated one of said hook-like members.

3. The apparatus of claim 2 wherein said coupling means is a flange integrally joined to said hollow cylindrical section and extending radially inwardly therefrom, and having an opening for receiving said hook-like member.

4. The apparatus of claim 1 wherein said elongated elastic retaining means comprises an elongated member having a significantly enlarged portion at each of its opposing ends;

each coupling means having an opening for receiving said elongated elastic member and having a surface upon which the enlarged portion of each end may rest when the portion of the elastic member immediately adjacent the enlarged portion extends through the opening in said coupling means.

5. The apparatus of claim 1 wherein said elongated elastic member is comprised of a closed-loop resilient member.

6. The apparatus of claim 5 wherein said closed-loop elastic member is a rubber band.

7. The apparatus of claim 5 wherein said coupling means comprises an integral projection extending radially inward from said cylindrical section having a free end turned away from the insert from the opposite end of said supply core to aid in retaining the elastic member thereon.

8. The apparatus of claim 1 wherein said coupling means comprises an annular integral flange extending inwardly from said cylindrical section and provided with a pair of spaced radially aligned slits forming a projection therebetween;

a closed-loop elastic member extending around said projection and through said slits for retaining both of said inserts within said supply core.

9. A pair of inserts each arranged to be held by one of the hands of an operator for use in dispensing a web from a supply roll, said web being an elongated sheet of wrapping film wrapped about a supply core comprising a hollow cylindrical core, said inserts each comprising:

a substantially hollow cylindrical section first and second open ends, the diameter of said cylindrical section being substantially constant over the length of said section, at least the first end of said section being substantially perpendicular to the axis of rotation of said cylindrical section;

an annular-shaped flange having it inner periphery integrally joined to said first end and extending radially outwardly from said cylindrical section, the diameter of the outer periphery of said flange being greater than that of said cylindrical section, said flange being substantially perpendicular to said cylindrical section;

at least one coupling means integrally joined to said cylindrical section;

said inserts being adapted for telescoping insertion into an associated end of said cylindrical core with said flange overlying at least the adjacent end of said cylindrical core, said inserts being formed of a plastic material having a low coefficient of sliding friction, the surface portion of said inserts facing said cylindrical core being smooth, whereby said insert is freely slidable and loosely engaged relative to said cylindrical core;

the length of said cylindrical core being greater than the combined lengths of said cylindrical sections whereby the adjacent ends of said cylindrical sections are spaced apart from one another;

retaining means arranged within said cylindrical core and engaging the coupling means of said inserts for urging said inserts toward one another and thereby retaining said inserts within the hollow cylindrical core.

* * * * *

UNITED STATES PATENT AND TRADEMARK OFFICE

CERTIFICATE OF CORRECTION

PATENT NO. : 4,582,273

DATED : April 15, 1986

INVENTOR(S) : Alfred Saraisky

It is certified that error appears in the above-identified patent and that said Letters Patent is hereby corrected as shown below:

Claim 9, column 8, line 31, after "section" insert --having--.

Signed and Sealed this

Seventh Day of October, 1986

[SEAL]

*Attest:*

DONALD J. QUIGG

*Attesting Officer*

*Commissioner of Patents and Trademarks*